United States Patent [19]

Thomas

[11] 4,398,549

[45] Aug. 16, 1983

[54] HAIR FROSTING PURSE

[76] Inventor: Louis N. Thomas, 990 NE. 156 Ter., North Miami Beach, Fla. 33162

[21] Appl. No.: 286,804

[22] Filed: Jul. 27, 1981

[51] Int. Cl.[3] ..... A45D 8/22

[52] U.S. Cl. ..... 132/9

[58] Field of Search ..... 132/9

[56] References Cited

U.S. PATENT DOCUMENTS

| | | | |
|---|---|---|---|
| 1,550,930 | 8/1925 | Sullivan | 132/9 |
| 3,103,933 | 9/1963 | Sanzo | 132/9 |
| 3,692,032 | 9/1972 | Rogas | 132/9 |

*Primary Examiner*—Gregory E. McNeill
*Attorney, Agent, or Firm*—Ernest H. Schmidt

[57] ABSTRACT

An elongated, rectangular, substantially flat member integrally molded of a resilient, chemically inert, synthetic plastic material is provided with a centrally located transverse groove permitting the folding over of a cover portion thereof against a shallow enclosure portion which is open at the outer end. A synthetic plastic clamp bar pivotally secured at one side of the open end serves to clamp hair strands to be frosted, bleached or dyed against the inner surface of the container. The cover portion enables full enclosure of the hair strands during the process.

5 Claims, 5 Drawing Figures

HAIR FROSTING PURSE

BACKGROUND OF THE INVENTION

In the hair styling procedure referred to commonly as "frosting" or "streaking", spaced groups of hair strands are separated and treated with bleach or dye, usually in the form of a paste or lotion, to effect the desired color "streaked" or "frosted" effect. In my patent application Ser. No. 06/180,693, filed Aug. 25, 1980, titled "Hair Strand Separating Implement", I describe a device for separating groups of hair strands for such treatment. Heretofore, various devices have been used to treat the groups of hair strands so separated with the bleaching or dying lotion or paste, all of which are difficult to apply, even by an experienced operator. Pieces of aluminum foil, for example, are commonly used for this purpose by placing the hair strands against one side of the foil, then applying the dying or bleaching paste or lotion to the hair strands, and finally folding marginal portions of the foil over the hair strands so treated to cover and enclose them for the length of time necessary for the paste or lotion to bleach or dye the hair.

SUMMARY OF THE INVENTION

It is, accordingly, the principal object of this invention to obviate the deficiencies of enclosure devices heretofore used for the treatment of separated groups of strands of hair separated at the scalp in the creation of the "frosted" or "streaked" hair style.

A more particular object of the invention is to provide a novel and improved hair frosting or dying purse of the character above described which, being integrally molded of a tough, resilient, substantially chemically inert material, can be reused indefinitely.

Another object of the invention is to devise a hair frosting purse which, because of its simplicity of operation, is so easy to apply to the scalp for the treatment of selected groups of hair strands, that is can easily be used for self-treatment at home as well as by the professional beauty operator.

Other objects are to provide novel and improved hair frosting purses which will be economical to manufacture, attractive in appearance, effective in operation and durable in use.

Other objects, features and advantages of the invention will be apparent from the following description when read with reference to accompanying drawings.

BRIEF DESCRIPTION OF THE DRAWINGS

In the drawings, wherein like reference numerals denote corresponding parts throughout the several views.

Figure 1:
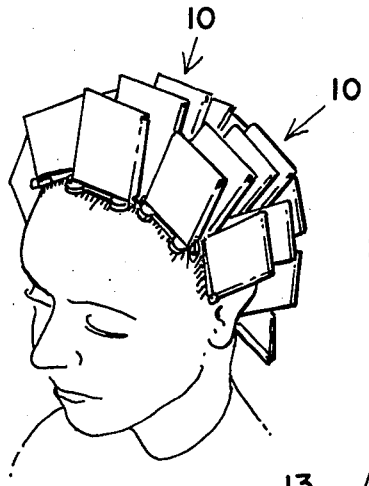
FIG. 1 illustrates, in perspective, the head of a person fitted with a plurality of hair frosting purses embodying the invention for dying or bleaching selected groups of hair strands.
Figure 2:
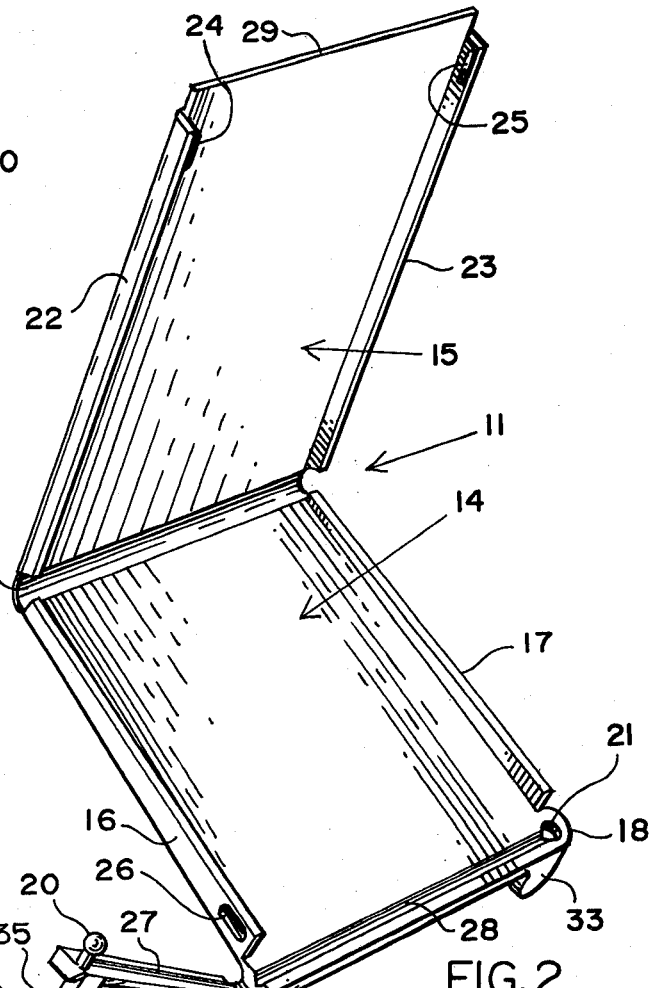
FIG. 2 is an oblique view of a hair frosting purse embodying the invention, shown separately and in open condition.
Figure 3:
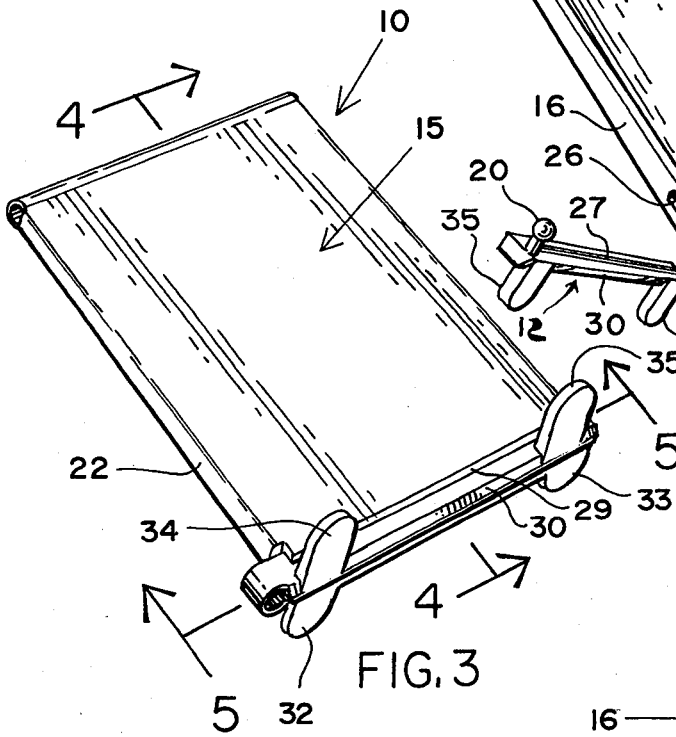
FIG. 3 is an oblique view similar of that to FIG. 2 but showing the hair frosting purse in closed condition.

Referring now in detail to the drawings, reference numeral 10 designates, generally, a hair frosting purse embodying the invention, a plurality thereof being shown in use in FIG. 1 in the performance of a hair streaking procedure as is hereinafter more particularly described. As best illustrated in FIG. 2, the hair frosting purse comprises an integrally formed body member 11 and an integrally formed clamping bar 12 swingably mounted to said body member in a manner and for the purpose hereinafter described. Both the body member 11 and the clamping bar 12 will preferably be integrally fabricated by molding of polypropolene or "Nylon" so as to be substantially chemically inert while at the same time somewhat resilient and structurally strong. The body member 11 is of substantially rectangular, elongated shape, with a central, transverse groove 13 along the inside providing an integral "live" hinge dividing said body member into an enclosure portion 14 and a cover portion 15 foldable down upon said enclosure portion (see FIG. 3). The longitudinal edges of the hair frosting purse enclosure portion 14 are integrally formed with short, upstanding, opposed sidewalls 16, 17, which gradually increase in height from their inner to outer ends, but which extend slightly short of the outer end of said enclosure portion. The outer end of enclosure portion 14 at one side extends laterally outwardly of the outer end of sidewall 17, to terminate in an arcuate bulge 18. The clamping bar 12 is integrally joined to the outer end of enclosure portion 14 at the side opposite arcuate bulge 18 by a reduced-thickness, "live" hinge portion 19. The opposite end of the clamping bar 12 is formed with a round-headed pin 20 for snap fit and friction retention in a through opening 21 provided in arcuate bulge 18 of enclosure portion 14. The size of headed pin 20 is such, with respect to its associated through opening 21, that it can be snapped in easily by hand to permit opening and closing of the clamp bar 12 in the manner and for the purpose hereinafter more particularly described.

Means is provided for full snap closing of the cover portion 15 down against the clamping bar 12 when in closed position. To this end, the cover portion 15 is integrally formed along each side with opposed, inwardly-directed, sidewall skirt portion 22, 23 which are formed, at the outer ends thereof, with laterally-opposed, inwardly-projecting, rounded, elongated protrusions 24, 25, respectively. The sidewalls 22, 23 are so laterally spaced that they fit slidingly against the outside of enclosure portion sidewalls 16, 17, respectively, upon closure of the frosting purse, whereupon the protrusions 24, 25 snap fit into opposed recesses 26 formed in the outside walls at the outer ends of enclosure portion sidewalls 16, 17 (only one recess 26 illustrated in FIG. 2.).

Figure 4:
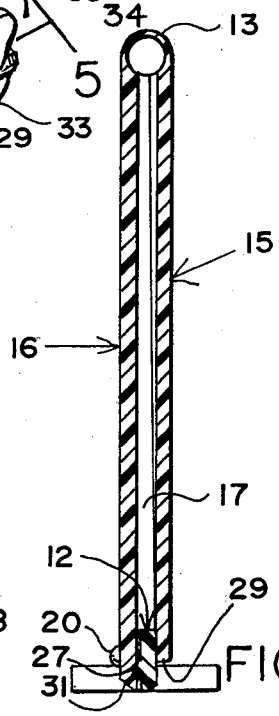
FIG. 4 is a longitudinal, cross-sectional view taken along the plane indicated at 4—4 of FIG. 3 and illustrating operation of the hair strand clamping bar.
Figure 5:
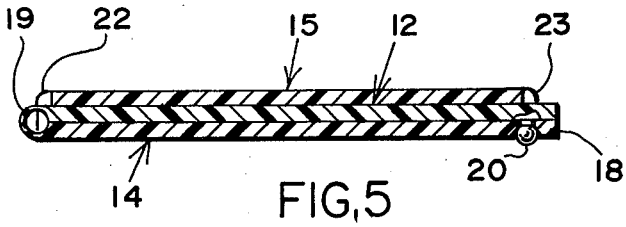
FIG. 5 is a transverse cross-sectional view taken along the plane indicated at 5—5 of FIG. 3.

As best illustrated in FIG. 4, the underside of the clamping bar 12 is formed along its length with an angular projection 27 which, upon closure of said clamping bar with respect to the hair frosting purse enclosure portion 14, is received in a complemental, longitudinally-extending groove 28 appropriately spaced from the outer end of said enclosure portion. As further illustrated in FIG. 4, the outer ends of the clamp bar 12 and the enclosure portion 14 are beveled, as indicated at 30 and 31, respectively, in FIG. 4 so that these ends of the frosting purse, when closed, have limited abutment contact with the scalp when the frosting purse is in use. The outer ends of the hair frosting purse enclosure portion 14 and clamp bar 12 are formed at each side with respective pairs of opposed, laterally outwardly-extending, projections 32, 33, and 34, 35, respectively, which serve as abutment feet keeping the installed hair frosting purses in substantially erect position upon the scalp during the hair treatment process, as illustrated in FIG. 1. The outer end of the cover portion 15 is foreshortened, as indicated at 29 in FIG. 3, so as to clear the laterally outwardly-extending projections 34, 35 of the clamp bar 12 upon closure of the hair frosting purse.

In use in dying or bleaching hair strand sections in the hair styling procedure referred to commonly as "frosting" or "streaking", spaced groups or sections of hair strands are separated from the rest of the hair at the scalp, in any conventional fashion, whereafter the outer end of the open enclosure portion of the hair frosting purse will be placed against the scalp adjacent to the selected group or sections of hair strands to be treated and clamped in place against the inside by moving clamping bar 12 over the outside of the hair strands and snapping it in place. The treating lotion or paste will be applied to the clamped strand groups, and the cover portion snapped closed until the chemical treatment is completed. As illustrated in FIG. 1, this procedure is repeated by use of plurality of the hair frosting purses to streak as much of the hair as is necessary to create the desired "streaked" or "frosted" effect in the coiffure.

While I have illustrated and described herein only one form in which my invention can be conveniently be embodied in practice, it is to be understood that this embodiment is presented by way of example only, and not in a limiting sense. The invention, in brief, comprises all the embodiments and modifications coming within the scope and spirit of the following claims.

What I claim as new and desire to secure by Letters Patent is:

1. A hair frosting or streaking purse comprising, in combination, a substantially rectangular enclosure portion having longitudinally extending sidewalls, a substantially rectangular cover portion hinged at one end to one end of said enclosure portion and movable in closing relation with respect to the inner surface of said enclosure portion, means for releasably clamping hair strands against the inner surface of said enclosure portion at the other end thereof, means for releasably securing said cover portion in said closing relation with respect to the inner surface of said enclosure portion, said enclosure and cover portions being integrally molded of resiliant, structurally strong, synthetic plastic material, said hinge between said enclosure portion and said cover portion comprising a transverse groove permitting relative flexure of said cover portion with respect to said enclosure portion, means for releasably clamping hair strands against the inner surface of said enclosure portion comprising a clamping bar, one end of said clamping bar being hinged to said enclosure portion at one side of said other end thereof, means for releasably securing the other end of said clamping bar against said enclosure portion at said other end thereof and at the side thereof opposite said hinged side, a pair of mutually laterally-spaced projections extending perpendicularly outwardly of each side of said outer end of said enclosure portion, a second pair of mutually laterally-spaced projections extending perpendicularly outwardly of said ends of said clamping bar, said projections having flat surfaces at their undersides, all of said flat surfaces, upon said other end of said clamping bar being secured against said enclosure portion, all lying in a substantially common plane and being adapted to rest substantially flat against the scalp upon the purse being installed upon the head for supporting the purse in erect position on the scalp during the hair treatment process.

2. A hair frosting or streaking purse as defined in claim 1, wherein the hinge between said clamping bar and said enclosure portion comprises a reduced-thickness "live" hinge portion permitting relative flexure of said clamping bar with respect to said enclosure portion.

3. A hair frosting or streaking purse as defined in claim 2, wherein the underside of said clamping bar is integrally molded with a longitudinally extending projection receivable in a complemental recess formed along said enclosure portion along said other end thereof.

4. A hair frosting or streaking purse as defined in claim 1, wherein said cover portion is integrally formed along each side with opposed, inwardly-directed, sidewall skirt portions so spaced as to overlap at the outside of the respective sidewalls of said enclosure portion upon closure of said cover portion with respect to said enclosure portion, said means for releasably securing said cover portion in said closing relation with respect to the inner surface of said enclosure portion comprising inwardly projecting protrusions at the outer ends of said sidewall skirt portions receivable one each in opposed recesses formed in the outer ends of said enclosure portion sidewalls.

5. A hair frosting or streaking purse as defined in claim 4, wherein said means for releasably clamping hair strands against the inner surface of said enclosure portion further comprises a round headed pin integrally formed with the other end of said clamping bar at the underside thereof and friction-fit receivable in a through opening provided in said enclosure portion at the other side of said other end thereof.

* * * * *